United States Patent [19]

Roberts et al.

[11] 4,230,061

[45] * Oct. 28, 1980

[54] LIQUID CARGO CONTAINER

[75] Inventors: William M. Roberts, Blauvelt; Jean Kohn, New York, both of N.Y.

[73] Assignee: Baltek Corporation, Northvale, N.J.

[ * ] Notice: The portion of the term of this patent subsequent to Jul. 18, 1995, has been disclaimed.

[21] Appl. No.: 920,251

[22] Filed: Jun. 29, 1978

Related U.S. Application Data

[63] Continuation-in-part of Ser. No. 786,878, Apr. 12, 1977, Pat. No. 4,101,045.

[51] Int. Cl.[2] ..... B63B 25/08; B63B 25/12; B65D 25/16; B65D 87/24

[52] U.S. Cl. ..... 114/74 A; 220/85 B; 220/404; 220/457; 220/461; 220/901; 428/255; 428/266

[58] Field of Search ..... 220/404, 901, 461, 85 B; 114/74 A; 428/266, 255

[56] References Cited

U.S. PATENT DOCUMENTS

| | | | |
|---|---|---|---|
| 2,994,452 | 8/1961 | Morrison | 220/901 X |
| 3,167,209 | 1/1965 | Jones | 220/461 |
| 3,177,501 | 4/1965 | Kwake | 220/404 X |
| 3,272,373 | 9/1966 | Allequme et al. | 220/461 X |
| 3,325,037 | 6/1967 | Kohn et al. | 220/456 X |
| 3,356,251 | 12/1967 | Roberts | 220/460 |
| 3,490,507 | 1/1970 | Grashorn | 139/389 X |
| 3,566,824 | 3/1971 | Cuneo | 220/901 X |
| 3,757,982 | 9/1973 | Isenberg et al. | 220/901 X |
| 3,848,765 | 11/1974 | Durkop | 220/461 X |
| 4,101,045 | 7/1978 | Roberts et al. | 220/901 X |

*Primary Examiner*—Allan N. Shoap
*Attorney, Agent, or Firm*—Michael Ebert

[57] ABSTRACT

A double-tank shipping container for general bulk liquid cargo, the container being constituted by a seagoing vessel having a single hull provided with a hold which defines the outer tank of the container and a prefabricated flexible bladder forming an inner tank received within the outer tank and readily removable therefrom. The inner tank has a configuration roughly conforming to the contours of the outer tank and yet capable of sustaining the liquid cargo in the event of a rupture in the outer tank, thereby to prevent spillage from the vessel and to avoid pollution of the seas.

3 Claims, 5 Drawing Figures

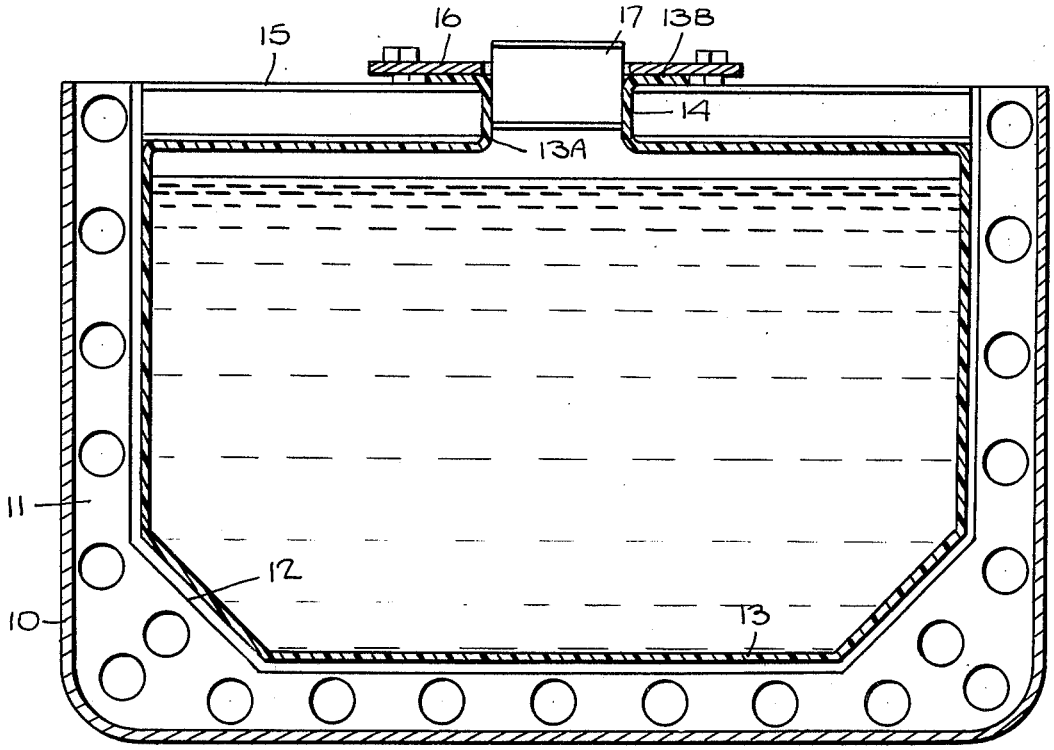
Fig. 1.
Fig. 4.
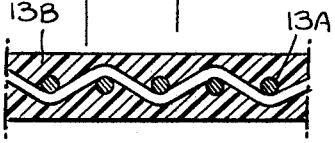
Fig. 3.
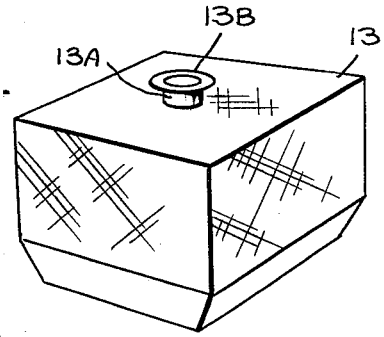
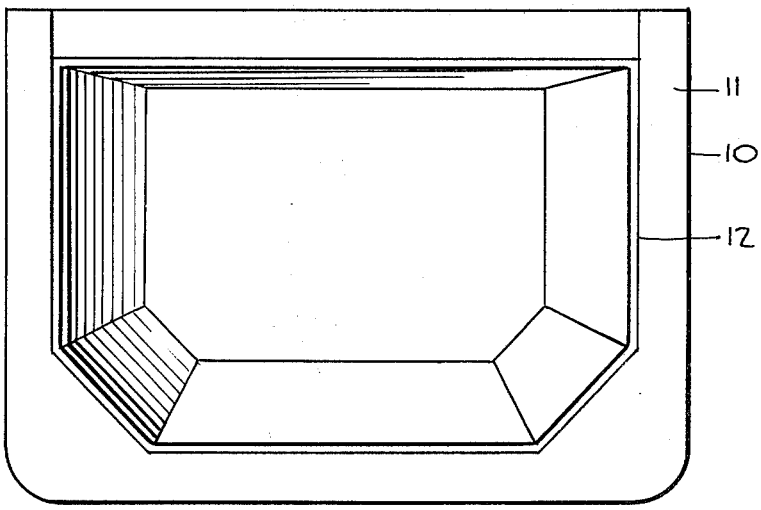
Fig. 2.
Fig. 5.
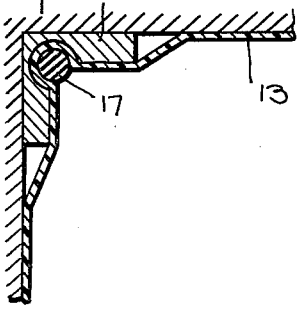

LIQUID CARGO CONTAINER

RELATED APPLICATION

This application is a continuation-in-part of our copending application Ser. No. 786,878, filed Apr. 12, 1977, entitled "Cryogenic Container," whose entire disclosure is incorporated herein by reference, now U.S. Pat. No. 4,101,045, issued July 18, 1978.

BACKGROUND OF INVENTION

This invention relates generally to containers for shipping general bulk liquid cargo, and more particularly to a spillage-resistant double-tank container constituted by a sea-going vessel whose single hull defines the outer tank of the container and a flexible bladder forming an inner tank received within the outer tank and roughly conforming thereto.

In transporting general bulk liquid cargo such as gasoline, crude oil and various other liquid chemicals in the cold or hot state, use is usually made of freighters, tankers or oil carriers having a single-layer hull having a hold which defines the container for the cargo. The serious problem encountered with such vessels is that should an accident or collision occur or the ship run aground, resulting in fracture or injury to the hull, the leakage of liquid into the surrounding sea may give rise to an intolerable pollution, particularly in the case of an oil spill.

Because of the international furor created by oil spills, various schemes have heretofore been proposed to minimize the danger of leakage from oil carriers. In most cases, the solution lies in a double hull vessel whose design is such that in the event of an accident or collision which impairs the structure of the outer hull, the inner hull can be expected to retain its integrity and prevent leakage of the liquid cargo held therein.

While a double hull structure affords the necessary safety factor, it represents a highly expensive solution which, if widely adopted, would render obsolute a great many single-hull vessels that are still in good working condition. Thus crude oil is presently being transported in huge sea-going carriers known as VLCC (Very Large Crude Carriers) having single hulls. The cost of replacing these vessels with double-hull structures would be enormous.

SUMMARY OF INVENTION

In view of the foregoing, the main object of this invention is to provide a double-tank liquid cargo container whose outer tank is defined by the hold of a single hull seagoing vessel and whose inner tank is formed by a flexible bladder that is received within the outer tank and is readily removable therefrom.

More particularly, it is an object of this invention to provide a double-tank container of the above type whose inner tank bladder has a configuration that roughly conforms to the contours of the outer tank, the bladder being capable of sustaining the liquid cargo in the event of a fracture in the outer tank to thereby prevent spillage from the vessel and objectionable pollution of the seas.

A salient advantage of the invention is that it becomes possible to convert existing single-hull vessels into double-tank containers for liquid cargo at relatively low cost, thereby preserving the existing heavy investment in such ships.

A significant feature of the invention is that the inner tank of the double-tank container serves as a primary liquid barrier and the outer tank, the ship's hull, as a secondary barrier, the inner tank being formed of a coated synthetic fabric bladder material of high strength which is structurally capable of supporting the liquid load, even in those areas where the bladder does not fully conform to the hold contour of the outer tank. Inasmuch as the wall of the bladder is not bonded to the hold and there is no need to precisely conform the geometry of the bladder to that of the hold, the cost of producing and installing a liquid-tight container in accordance with the invention is substantially lower than that of a double-hull of the type heretofore known. Moreover, it becomes possible to fabricate the bladder at a factory site remote from the vessel under careful quality-control conditions.

The primary barrier layer created by the bladder normally serves to ensure the leakage-free transport of the cargo, whereas the secondary barrier formed by the ship's hull affords a safety factor should the primary barrier fail. However, should the failure be in the secondary barrier, insurance against leakage is afforded by the primary barrier.

Another feature of a bladder-type inner tank for a double-tank container in accordance with the invention is that it needs less space on board ship, resulting in smaller ships for a given volume of transported liquid. A flexible inner tank affords easy access to the ship's hold for purposes of inspection and repair. Should it be necessary to make repairs on the bladder, this can be done inexpensively and with no greater difficulty than when fixing a flat tire on a car. And because the inner bladder is not bonded to the ship's hull, the hull may be readily inspected and repaired or painted simply by folding or moving the empty bladder away from the wall of the outer tank or removing the bladder altogether.

To further enhance the safety factor, the inner tank may be composed of a group of relatively small bladders which cooperate with the common outer tank defined by the ship's hull, so that should there be a failure both in the hull and in one of the several bladders, spillage from the vessel would then be limited to the leakage from the failed small bladder.

Briefly stated, these objects are attained in a double-tank shipping container for general bulk liquid cargo such as crude oil, the container being constituted by a sea-going vessel having a single hull provided with a hold which defines the outer tank of the container, and a prefabricated flexible bladder formed by a fabric of synthetic plastic fibers coated with a compatible film defining an inner tank which is received within the outer tank and is removable therefrom, the inner tank having a configuration which roughly conforms to that of the outer tank and having a structural strength capable of sustaining the liquid cargo in the event of a rupture in the outer tank.

OUTLINE OF DRAWINGS

For a better understanding of the invention as well as other objects and further features thereof, reference is made to the following detailed description to be read in conjunction with the accompanying drawings, wherein:

FIG. 1 is a transverse section taken through a ship's hull;

FIG. 2 is a perspective view of the interior of the container;

FIG. 3 is a perspective view of the inner tank;

FIG. 4 is a longitudinal section taken through the material of the inner tank; and FIG. 5 illustrates one manner of temporarily attaching the inner tank to the inner wall of the ship's hull.

DESCRIPTION OF INVENTION

Referring now to FIGS. 1 and 2, there is shown a double-tank container in accordance with the invention for shipping general bulk liquid cargo such as crude oil or other chemical liquid. The outer tank of the container is formed by a sea-going vessel having a single hull 10 of high-strength metal such as steel and a reinforcing frame 11 which supports a prismatically shaped hold 12. In conventional arrangements for shipping a liquid cargo, this hull serves as the tank for the liquid. There is no safety factor in this arrangement; for should the hull be fractured as a result of the ship running aground or a collision, the liquid will leak out of the hold and pollute the surrounding waters.

Received within the outer tank is an inner tank 13 constituted by a collapsible flexible bladder formed of a synthetic plastic fabric material which is coated with a compatible material to render it liquid and gas-impervious so that the bladder acts as a primary barrier. Bladder 13 is provided with an inlet neck 13A that is dimensioned to pass through a port 14 in the upper deck 15 of the vessel. The upper end of the neck terminates in a flange 13B which lies against the outer surface of the deck.

Flange 13B is clamped to the neck by a ring 16 which is bolted or otherwise secured thereto. Thus the independent tank or bladder 13 is suspended by its neck from the deck. The opening of the neck may be sealed by a conventional stopper 17.

The inner configuration of hold 12 has a prismatic form, while the geometry of the bladder, as best seen in FIG. 3, roughly conforms to the contours thereof. However, the bladder has sufficient strength to support the liquid load; hence irregularities between the bladder and hold geometries are tolerable. If, therefore, any area of the bladder fails to conform to the outer tank surface to create a space therebetween, the lack of back support at this point will not cause rupture of the bladder.

Since the independent bladder is formed of flexible fabric material, it may be collapsed and lowered into the outer tank through port 14 in the deck of the vessel. When the bladder is filled with liquid, it will then be caused to assume its normal shape. However, it may be desirable before filling the bladder to prevent its collapse. For this purpose, the corner edges of the bladder, as shown in FIG. 4, may be anchored by a spline 17 formed of flexible and resilient material having acceptable cryogenic properties in long channels 18 secured to the corners of the hold. Alternatively, the bladder may be provided at selected positions with loose strings that may be tied to hooks secured to the inner walls of the outer tank.

It is essential that the fabric material from which the bladder is made be non-reactive with the liquid cargo and of sufficient strength to structurally support the liquid load. For this purpose, the fabric may be woven or otherwise fabricated from nylon, polyester, or Dacron, the latter being a polyester fiber made from polyethylene terephthalate. Dacron has exceptional tensile strength as well as high elastic recovery. It is difficult to ignite and self-extinguishing. The preferred material for the bladder fabric is Kelvar, which is an aramid fiber formed from a long chain synthetic polyamide in which at least 85% of the amide linkages are attached directly to aramatic rings.

As shown in FIG. 4, the woven fabric 13A is coated with a film layer 13B which acts to render it liquid and gas-impervious. This film must be compatible to and adherent with the fabric. In practice, it may be a fluorocarbon polymer such as TFE, a silicone rubber elastomer, or Vitron.

The bladder or independent inner tank may be manufactured at a factory remote from the ship. The bladder can thereafter be lowered through the port in the deck of the ship defining the outer tank and suspended only from the neck, or it may have a few tie-down restraints, as previously mentioned. This procedure greatly reduces the need for on-site construction labor and also makes possible a high order of quality control, for the complete bladder may be carefully checked and tested at the factory prior to its installation at the ship.

While there has been shown and described a preferred embodiment of a double-tank container for liquid cargo in accordance with the invention, it will be appreciated that many changes and modifications may be made therein without, however, departing from the essential spirit thereof. Thus instead of a single bladder, the inner tank may be constituted by a battery of small bladders which fit within the hold serving as an outer tank common to all of the bladders, so that should both the outer tank fail and one or more of the several bladders, the leakage will be limited to the contents of the failed bladders.

We claim:

1. A double-tank shipping container for general bulk liquid cargo such as crude oil, said container comprising:

A a single hull sea-going vessel whose liquid-impervious hold has a prismatic formation which is spaced from the hull by a reinforcing frame to define a thermally-uninsulated outer tank capable of independently containing said liquid cargo and serving as a secondary barrier for the liquid, the deck of said vessel having an inlet port communicating with said hold;

B a removable inner tank insertable in said outer tank and serving as a primary barrier, said inner tank being constituted by a collapsible bladder of flexible fabric woven of polyester material and coated with a liquid- and gas-impervious film which is a silicone-rubber elastomer which may be lowered in the collapsed state into said hold through said port, said bladder having a geometry roughly conforming to the configuration of the hold whereby those areas of the bladder that do not exactly conform to the hold are unsupported thereby, said bladder being formed of a coated fabric material of sufficient strength as to resist rupture in the unsupported areas; and C detachable means at selected positions to anchor said collapsible bladder in the hold to maintain the normal shape of the bladder when it is empty.

2. A container as set forth in claim 1, wherein said bladder includes a neck portion that lines said port.

3. A bladder as set forth in claim 2, wherein said neck portion with a flange that lies against said deck and is clamped thereto.

* * * * *